United States Patent [19]

Miyawaki

[11] Patent Number: 5,000,799

[45] Date of Patent: Mar. 19, 1991

[54] ZINC-NICKEL PHOSPHATE CONVERSION COATING COMPOSITION AND PROCESS

[75] Inventor: Toshi Miyawaki, Kanagawa, Japan

[73] Assignee: Nihon Parkerizing Co., Ltd., Tokyo, Japan

[21] Appl. No.: 412,063

[22] Filed: Sep. 25, 1989

[30] Foreign Application Priority Data

Sep. 27, 1988 [JP] Japan ..... 63-241577

[51] Int. Cl.[5] ..... C23C 22/12

[52] U.S. Cl. ..... 484/259; 148/262

[58] Field of Search ..... 148/259, 262

[56] References Cited

U.S. PATENT DOCUMENTS 4,637,838 1/1987 Rausch et al. ..... 148/6.15

*Primary Examiner*—Sam Silverberg

*Attorney, Agent, or Firm*—Ernest G. Szoke; Wayne C. Jaeschke; Norvell E. Wisdom, Jr.

[57] ABSTRACT

The operation of zinc-nickel phosphate conversion coating of active metals is improved by using phosphating solutions containing formic acid or formate ions. Such solutions can work effectively at low temperatures and provide excellent substrates for paint, particularly that applied by electrodeposition.

8 Claims, No Drawings

ZINC-NICKEL PHOSPHATE CONVERSION COATING COMPOSITION AND PROCESS

FIELD OF THE INVENTION

This invention relates to a phosphate conversion treatment solution which is optimized for use by immersion or dipping at temperatures not exceeding approximately 45 degrees Centigrade ("° C.") for the purpose of forming a zinc phosphate-based film which can be coated with conventional organic surface coatings such as paint to make a product that has both excellent corrosion resistance and excellent resistance to weakening of the adhesion of the surface coating by exposure to water. The conversion coating produced by this invention finds application as a base coating or undercoating, and particularly as an undercoating before cathodic electrodeposition coating of paints and similar materials, on the surfaces of metals, particularly iron, steel, galvanized steel, or zinc-alloy coated steel (for example, hot-dip galvanized, electroplated galvanized, zinc/nickel-plated steel sheet, zinc/iron-plated steel sheet, and the like), as well as on the surfaces of articles principally constituted of such a metal as listed above, for example, automobile bodies.

STATEMENT OF RELATED ART

The general use of zinc phosphating solutions in protecting active metal objects is well and widely known. Such treatment solutions can be roughly classified into nickel/zinc phosphate-based conversion treatment solutions used mainly for iron and steel articles and nickel/-manganese/zinc phosphate-based conversion treatment solutions used principally on articles of iron, steel, and galvanized or zinc alloy-plated steels. Nickel contributes to increasing the corrosion resistance after a subsequent protective surface coating, while manganese contributes to increasing the alkali resistance necessary for cathodic electrodeposition. Furthermore, manganese also functions to improve the water resistance of organic surface coatings over the phosphate film on zinc-rich surfaces.

These phosphating solutions normally contain nitrate ion and/or chlorate ion as oxidizing agents or accelerators, as well as fluoride in the form of complex fluoride ion. Auxiliary accelerators may be added in the form of $NO_2^{31}$ at 0.01 to 0.2 g/L and nitrobenzenesulfonate ("NBS") ion at 0.3 to 2.0 g/L. The solution is typically used at temperatures within the range of 30° to 60° C., by immersion, dipping, spraying, or a combination of such contact methods.

The corrosion resistance imparted by a coating or paint on a phosphate film can be improved by increasing the nickel content in the phosphate film, and this can be accomplished by raising the nickel ion concentration in the phosphate conversion treatment solution. However, raising the nickel ion concentration to high levels is expensive. Also, when the nickel ion concentration in the treatment solution is raised, although the nickel content in the conversion film is in fact increased, the problem arises that, when manganese is present in the treatment solution, the nickel content in the film cannot be increased as much as would be otherwise expected. Furthermore, if the quantity of manganese in the treatment solution is reduced in order to increase the nickel content of the phosphate film, the manganese content of the film is then reduced, and the alkali resistance and water resistance are both reduced. In contrast to this, when the quantity of manganese is increased in order to increase the alkali resistance and the water resistance, the quantity of nickel in the film then declines and the corrosion resistance is thereby reduced.

U.S. Pat. No. 4,637,838 of Jan. 20, 1987 to Rausch et al. describes zinc phosphating solutions with lower than usual zinc ion contents, optionally containing nickel ion, and containing at least one activator from the group selected from the group consisting of formate, nitrilotriacetate, trichloroacetate, and ethylenediamine tetraacetate.

It is an object of the present invention to provide conversion coating films for which corrosion resistance, water resistance, and alkali resistance are all good, despite the antagonistic competition between manganese and nickel contents in the treatment solutions as noted above, and which are deposited by contact with solutions that contain more zinc than those solutions taught by U.S. Pat. No. 4,637,838. It is also an object of the present invention to provide phosphating compositions suitable for use at temperatures at least as low as 20° C.

DESCRIPTION OF THE INVENTION

In this description, except in the examples or where expressly stated to the contrary, all numbers specifying amounts of materials or conditions of reaction or use are to be understood as modified by the term "about".

It has now been found that it is possible to obtain a higher nickel content in the film than was normally achieved in the prior art, when using a treatment solution having a relatively low nickel ion concentration, through the addition of formate salts and/or formic acid, preferably at a concentration of from 0.3 to 5 gram per liter of treatment solution ("g/L") calculated as $HCOO^-$. Alkali metal salts, alkaline earth metal salts, ammonium salt, and heavy metal salts, preferably nickel, cobalt, iron, and manganese salts, of formic acid can all be used, provided that they are sufficiently soluble in water in preparing the nickel containing zinc phosphate based treatment solutions according to the invention. Both nickel/zinc and manganese/nickel/zinc phosphate conversion treatment solution as described above may be used in the invention. The beneficial effects of formate are particularly marked in nickel containing phosphate conversion treatment solutions which contain 0.01 to 0.2 g/L of nitrite ion and/or 0.3 to 2.0 g/L of NBS ions.

Furthermore, the treatment solution of the present invention is particularly effective when applied by immersion or dipping at temperatures not exceeding 45° C.

The phosphate conversion treatment solution of the present invention functions efficiently as a nickel containing zinc phosphate-based conversion treatment solution for the application of an underpaint coating in general, but particularly for the application of a base or ground coat prior to cathodic electrodeposition coating.

Suitable components, in addition to water, for a phosphate conversion treatment solution according to the invention and their preferred concentration ranges when present are as follows:

| | | |
|---|---|---|
| $Zn^{+2}$ ions | >0.5 to 2.0 | g/L |
| $Ni^{+2}$ ions | 0.5 to 3.0 | g/L |
| $Mn^{+2}$ ions | 0.3 to 1.5 | g/L |
| Phosphate ions | 10 to 25 | g/L |
| Total F Ions | 0.5 to 2.0 | g/L |

-continued

| | | |
|---|---|---|
| $NO_3$ ions | 2.0 to 15 | g/L |
| $ClO_3$ ions | 0.1 to 1.0 | g/L |
| $NO_2$ ions | 0.01 to 0.2 | g/L |
| nitrobenzenesulfonate | 0.3 to 2.0 | g/L. |

$Zn^{+2}$ ions are an essential component, and their content in the treatment solution should be more than 0.5 up to 2.0 g/L. It becomes difficult to produce a uniform phosphate film with 0.5 g/L or less. In excess of 2.0 g/L, the soft hopeite component $Zn_3(PO_4)_2.4H_2O$ in the film increases, resulting in poorer paint film adherence after electrodeposition coating. Minimum amounts of 0.7 and 0.8 g/L for the concentration of zinc ions are increasingly preferred, and a maximum concentration of 1.5 g/L of zinc ion is also preferred.

$Ni^{+2}$ ions are also an essential component, and their concentration preferably should be 0.5 to 3.0 g/L. With less than 0.5 g/L, nickel and nickel zinc phosphate {phosphonickelite, $Zn_2Ni(PO_4)_2.4H_2O$} are not deposited in optimal quantities in the film, even when using a treatment solution with formic acid or formate in it. As a result, both the corrosion resistance after subsequent coating and the desirable formation of dense, fine-sized phosphate film crystals are reduced. One cannot expect an increase in film quality in proportion to the high cost of the treatment solution at nickel ion levels in excess of 3.0 g/L. Furthermore, 3.0 g/L is also the limit in the case of manganese-containing zinc phosphate-based conversion treatment solutions. As a general matter, 2.0 g/L is more preferable as the upper limit.

When all or part of an article receiving treatment consists of galvanized or zinc alloy-plated steel, $Mn^{+2}$ ions are preferably added to the phosphating solution in order to improve the alkali resistance and water resistance after cathodic electrodeposition coating of the zinc phosphate-based film formed with such a solution. The quantity of Mn ion preferably falls within the range of 0.3 to 1.5 g/L, because it is within this range that the aforementioned effect is generally observed. The film-forming properties and corrosion resistance are reduced with manganese ion concentrations in excess of 1.5 g/L, and an upper limit of 1 g/L is more preferred.

Phosphate ions derived from orthophosphoric acid ($H_3PO_4$) are an essential component of the solutions according to the invention; they are measured as their stoichiometric equivalent as $PO_4^{-3}$ ions. The concentration of this component is regulated in part through the total acidity of the treatment solution, and 10 to 25 g/L is preferably present.

The "Total F Ions" component includes all simple and complex fluorine-containing anions present in the solution. Preferably this component, if present, is derived from hydrofluoric acid, fluorosilicic acid, and/or fluoroboric acid and/or a salt thereof. The preferable concentration of Total F Ions is from 0.5 to 2.0 g/L of stoichiometric equivalent as $F^-$ *ion. Total F Ions are used primarily to obtain such effects as lowering the temperature for phosphate film formation, obtaining microfine film crystals, and increasing the amount of phosphoferrite* {$Zn_2Fe(PO_4)_2.4H_2O$} in the conversion coatings formed on steel sheet. The aforementioned effects are only weakly evidenced with less than 0.5 g/L of Total F Ions, while no increased benefit can be expected for a concentration in excess of 2.0 g/L, thus making it advantageous to take 2.0 g/L as the preferred upper limit.

Sufficient total oxidizing agent or accelerator is required in solutions according to the invention in order to achieve film formation in a practically short time. Nitrate and/or chlorate ions are the preferred accelerators. It is preferred that $NO_3^-$ ions be present at a concentration of from 2.0 to 15 g/L in the solutions according to the invention, while $ClO_3^-$ ions are preferred at a concentration of from 0.1 to 1.0 g/L. Ordinarily only one of these two alternative accelerators would be used in any particular solution according to the invention, but if desired they could be mixed. Formation of a continuous conversion coating is difficult at accelerator concentrations below the specified lower limits. On the other hand, it is disadvantageous to exceed the given upper limits because the film quality is then reduced.

$NO_2^-$ ions are preferably included as an auxiliary accelerator in solutions according to this invention, even when nitrate and/or chlorate as specified above is also present, and the nitrite ions are preferably present within the concentration range from 0.01 to 0.2 g/L. An alternative auxiliary accelerator is nitrobenzenesulfonate ion, usually used in the form of nitrobenzenesulfonic acid, preferably within the concentration range from 0.3 to 2.0 g/L. Film formation may be inadequately accelerated at below the stated preferred lower limit values. On the other hand, not only can an increased acceleration not be expected for a concentration of auxiliary accelerator in excess of the given preferred upper limits, but the component balance in the treatment solution tends to be destroyed during aging of the solutions.

Formic acid and/or a salt thereof is an essential component of the phosphate conversion treatment solution of the present invention and can be selected, for example, from formic acid, the alkali metal salts of formic acid, the alkaline earth metal salts of formic acid, the ammonium and substituted ammonium salts of formic acid, and the heavy metal salts of formic acid. More particularly, reference is made to such formates as HCOONa, HCOOK, $(HCOO)_2Ca$, $(HCOO)_2Ba$, $HCOONH_4$, $(HCOO)_2Ni.2H_2O$, $(HCOO)_2Co.\ 2H_2O$, $(HCOO)_3Fe.2H_2O$, and $(HCOO)_2Mn.2H_2O$. The concentration should preferably fall within the range of 0.3 to 5 g/L, measured as the stoichiometric equivalent of $HCOO^-$ ions. Below 0.3 g/L little benefit from the presence of formate has been observed, while no improvement in effect can be expected for an addition in excess of 5 g/L, and, in addition, the decomposition rate of the accelerator is increased, leading to higher cost. A formate concentration from 1.0 g/L to 3.0 g/L is even more preferred.

In the preferred practice of process embodiments of the present invention, a metal surface, preferably one of iron, steel, galvanized steel, or zinc alloy-plated steel, or an article principally constituted of such metal(s), for example, an automobile body, is first surface rinsed with a weakly alkaline rinse solution and then rinsed with water, optionally and preferably followed by conditioning of the surface using a solution containing colloidal titanium (surface "activator"). Then the object is brought into contact with a phosphate conversion treatment solution of the present invention, generally at 20° to 55° C., preferably at 20° to 45° C., for 30 to 180 seconds. A particularly preferred process according to this invention is one operated at comfortable ambient temperatures for humans, i.e., between about 20° to 29°, or more preferably between about 20° to 27° C.

With regard to the films formed by means of phosphating according to this invention, on iron and steel surfaces, these films contain $Zn_2Fe(PO_4)_2.4H_2O$ as their principal component, $Zn_2Ni(PO_4)_2.4H_2O$ and possibly $Zn_2Mn(PO_4)_2.4H_2O$ as secondary components, small quantities of $Zn_3(PO_4)_2.4H_2O$, and very small quantities of metallic Ni; on zinc-based surfaces, these films contain $Zn_3(PO_4)_2.4H_2O$ as their principal component, $Zn_2Ni(PO_4)_2.4H_2O$ and possibly $Zn_2Mn(PO_4)_2.4H_2O$ as secondary products, $Zn_2Fe(PO_4)_2.4H_2O$ when $Fe^{2+}$ is present in the treatment solution, and small quantities of metallic Ni.

Phosphate conversion coating films with relatively large Ni contents can be obtained from solutions according to this invention.

The practice and value of the invention may be further appreciated by considering the following working and comparative examples.

EXAMPLES

The following general materials and conditions were used for all the examples:

1. Metal Substrates Treated (1) Steel according to Japanese Industrial Standard G-3141 SPCC (abbreviated as SPC)
(2) Electrogalvanized steel sheet (abbreviated as EG)
(3) Hot-dipped galvanized steel sheet (abbreviated as GA)

2. Treatment Steps Before Final Surface Coating (1) Degreasing, using an aqueous solution of Fine-cleaner L-4410 TM (abbreviated FC-L4410, a strong alkali cleaner from Nihon Parkerizing Company, Limited): FC-L4410A TM at 16 g/L and FC-L4410B TM at 12 g/L. 40°±2° C. for 180 seconds immersion.
(2) Tap water rinse at room temperature for 20 seconds, spray.
(3) Surface conditioning by immersion for 30 seconds in an aqueous solution of 1 g/L of Prepalen ® ZN, a titanium-containing surface conditioner from Nihon Parkerizing Company, Ltd.
(4) Phosphating by immersion for 120 seconds in a bath with a composition and at a temperature shown in Table 1.
(5) Tap water rinse by spray at room temperature for 20 seconds.
(6) De-ionized water spray rinse for 20 seconds with water having a conductivity of about 0.2 microsiemens/centimeter ("μS/cm").
(7) Drying in air at 110° C. for 180 seconds.

Concentration Measurement Methods for the Phosphate Conversion Treatment Solutions

Free Acidity (FA)

Ten milliliters ("mL") of treatment solution was sampled and neutralized with N/10 NaOH using Bromophenol Blue as the indicator. The number of mL of N/10 NaOH required to convert the color from yellow to blue was taken as the points of free acidity.

Total Acidity (TA)

Ten mL of treatment solution was sampled and neutralized with N/10 NaOH using phenolphthalein as the indicator. The number of mL of N/10 NaOH required to convert from colorless to pink was taken as the points of total acidity.

TABLE 1

| | Examples | | | | | | | Comparison Examples | | |
|---|---|---|---|---|---|---|---|---|---|---|
| | 1 | 2 | 3 | 4 | 5 | 6 | 7 | 1 | 2 | 3 |
| phosphating treatment bath composition | | | | | | | | | | |
| $Zn^{2+}$ g/L | 0.8 | 1.0 | 0.8 | 1.0 | 1.3 | 1.5 | 1.0 | 0.8 | 1.3 | 1.5 |
| $Ni^{2+}$ g/L | 1.0 | 1.5 | 1.0 | 1.5 | 2.0 | 1.5 | 2.0 | 1.0 | 2.0 | 1.5 |
| $Mn^{2+}$ g/L | 0 | 0 | 0.5 | 0.5 | 1.0 | 0.5 | 0.5 | 0 | 1.5 | 0.5 |
| $PO_4^{3-}$ g/L | 15.0 | 15.0 | 15.0 | 15.0 | 17.0 | 16.0 | 15.0 | 15.0 | 17.0 | 16.0 |
| total F g/L | 1.0 | 1.0 | 1.0 | 1.0 | 1.0 | 1.0 | 1.0 | 1.0 | 1.0 | 1.0 |
| $NO_3$ g/L | 7.0 | 7.0 | 7.0 | 7.0 | 7.0 | 7.0 | 5.0 | 7.0 | 7.0 | 7.0 |
| $NO_2$ g/L (+NBS) g/L | 0.12 | 0.12 | 0.12 | 0.12 | 0.12 | 0.24 | 0.1+ 0.4 ($NO_2$NBS) | 0.12 | 0.12 | 0.24 |
| $HCOO^-$ g/L | 3.0 | 1.0 | 1.0 | 2.5 | 2.0 | 2.0 | 0.5 | 0 | 0 | 0 |
| concentrations | | | | | | | | | | |
| FA points | 0.8 | 0.8 | 0.8 | 0.8 | 1.1 | 0.1 | 0.9 | 0.8 | 1.1 | 0.1 |
| TA points | 21.8 | 22.6 | 22.4 | 23.2 | 22.2 | 24.1 | 23.9 | 21.8 | 27.7 | 24.0 |
| conditions | | | | | | | | | | |
| temperature, °C. | 40 | 40 | 40 | 40 | 40 | 30 | 40 | 40 | 40 | 30 |
| treatment method (I = immersion) | I | I | I | I | I | I | I | I | I | I |
| time, seconds | 120 | 120 | 120 | 120 | 120 | 120 | 120 | 120 | 120 | 120 |

| | Examples | | | | | | | | | | | | | | | |
|---|---|---|---|---|---|---|---|---|---|---|---|---|---|---|---|---|
| | 1 | | | 2 | | 3 | | 4 | | 5 | | 6 | | | 7 | |
| test steel sheet | EG | SPC | GA | EG | SPC | EG | SPC | EG | SPC | EG | SPC | EG | SPC | GA | EG | SPC |
| phosphate film | | | | | | | | | | | | | | | | |
| external appearance | + | + | + | + | + | + | + | + | + | + | + | + | + | + | + | + |
| film weight in g/m² | 3.2 | 2.2 | 3.4 | 3.3 | 2.3 | 3.1 | 2.2 | 3.1 | 2.1 | 3.1 | 2.2 | 3.0 | 2.2 | 3.4 | 3.0 | 2.3 |
| Ni uptake in mg/m² | 94 | 27 | 120 | 116 | 31 | 76 | 22 | 101 | 25 | 93 | 26 | 88 | 21 | 113 | 123 | 31 |
| Mn uptake in mg/m² | — | — | — | — | — | 90 | 45 | 88 | 47 | 169 | 72 | 76 | 36 | 137 | 89 | 45 |
| alkali resistance, % | 66 | 58 | 70 | 72 | 63 | 73 | 65 | 76 | 67 | 76 | 66 | 71 | 65 | 77 | 75 | 63 |

TABLE 1-continued

| | | | | | | | | | | | | | | | | |
|---|---|---|---|---|---|---|---|---|---|---|---|---|---|---|---|---|
| coating properties evaluation | | | | | | | | | | | | | | | | |
| resistance to hot salt water | 4.0 | 1.5 | 3.0 | 3.0 | 1.5 | 4.0 | 1.0 | 3.5 | 1.5 | 4.0 | 1.5 | 4.0 | 1.0 | 3.0 | 3.0 | 1.5 |
| water resistance | 100 | 100 | 100 | 100 | 100 | 100 | 100 | 100 | 100 | 100 | 100 | 100 | 100 | 100 | 100 | 100 |
| of secondary adhesion | 100 | 100 | 100 | 100 | 100 | 100 | 100 | 100 | 100 | 100 | 100 | 100 | 100 | 100 | 100 | 100 |

| | Comparison Examples | | | | | | | |
|---|---|---|---|---|---|---|---|---|
| | 1 | | | 2 | | 3 | | |
| test steel sheet | EG | SPC | GA | EG | SPC | EG | SPC | GA |
| phosphate film | | | | | | | | |
| external appearance | + | + | + | + | + | + | + | + |
| film weight in g/m$^2$ | 3.0 | 2.0 | 3.4 | 2.3 | 2.1 | 2.9 | 2.2 | 3.3 |
| Ni uptake in mg/m$^2$ | 71 | 19 | 89 | 52 | 23 | 62 | 15 | 81 |
| Mn uptake in mg/m$^2$ | — | — | — | 221 | 96 | 78 | 38 | 138 |
| alkali resistance, % | 57 | 49 | 64 | 64 | 55 | 64 | 50 | 68 |
| coating properties evaluation | | | | | | | | |
| resistance to hot salt water | 6.5 | 2.5 | 4.0 | 7.5 | 1.5 | 7.0 | 2.0 | 4.5 |
| water resistance | 88 | 96 | 100 | 100 | 100 | 100 | 100 | 100 |
| of secondary adhesion | 100 | 100 | 100 | 100 | 100 | 100 | 100 | 100 |

Accelerator Concentration

Treatment solution was collected in a saccharometer (50 mL measurement capacity), and 2 to 5 grams ("g") of sulfamic acid was added. The device was turned over to allow the sulfamic acid to reach the treatment solution in the other end of the saccharometer, and was then returned to its original position. The number of mL of gas generated in the detection region was measured for calculation of the accelerator concentration.

3. Surface Coating Steps (1) Electrodeposition coating
  (a) Electron ® 9400 (cationic electrodeposition coating from Kansai Paint Company, Limited) was used at a bath temperature of 28° C. and an electrodeposition voltage of 250 V for 180 seconds to produce a film thickness of 20 microns.
  (b) Spray tap water rinse for 20 seconds.
  (c) Spray rinse with deionized water with a conductivity of about 0.2 μS/cm at room temperature for 5 seconds.
  (d) Bake for 30 minutes at 175° C.
(2) Intermediate coating
  Amilac ® N-2 Sealer (melamine-alkyd resin coating from Kansai Paint Company, Limited) was applied with an air sprayer to give a dry film thickness of 30 microns, followed by setting for 10 to 20 minutes and then baking for 30 minutes at 140° C.
(3) Top coating
  Amilac ® White M3 (melamine-alkyd resin coating from Kansai Paint Company, Limited) was applied using an air sprayer to give a dry film thickness of 40 microns, followed by setting for 10 to 20 minutes and then baking for 30 minutes at 140° C. The total film thickness of the 3 coats on the coated sheet was 90 microns.

4. Evaluations of the Phosphate Film as Shown in Table 1

(1) External appearance of film
  + = dense, fine, and uniform phosphate film
  x = unsatisfactory nonuniform film, with occurrence of yellow rust
(2) Coating weight
  (a) On SPC, the coating weight was calculated from the weights before and after stripping with 50 g/L aqueous chromium trioxide (units: g/m$^2$).
  (b) On zinc coated steel sheet, the coating weight was calculated from the weights before and after stripping with an aqueous solution prepared by adding sufficient distilled water to 20 g of ammonium bichromate and 480 g of 29% aqueous ammonia to give 1 L (units: g/m$^2$).
(3) Alkali resistance of the film
  Phosphated steel sheet was immersed in 0.1 N NaOH for 5 minutes at 30 degrees Centigrade. The quantity of phosphorus before and after immersion was compared using a fluorescent X-ray analyzer. The alkali resistance of the film was measured, on each of three test specimens, by the percentage of phosphorous retained after this immersion in alkali $$= \frac{\text{P counts after immersion}}{\text{P counts before immersion}} \times 100$$

5. Add-on or Uptake of Ni and Mn as Shown in Table 1

This property is shown in mg/m$^2$, as measured using a fluorescent X-ray analyzer (System 3070 from Rigaku Denki Kabushiki Kaisha).

6. Evaluation of Properties After Coating as Shown in Table 1

(1) Resistance to hot salt water

An electropainted sheet (i.e., one after only step (1) of the surface coating described above) was scribed deeply enough to penetrate into bare metal and then immersed in 5% saltwater at 55° C. for 240 hours. Adhesive tape was then applied to the cut, pressed down by finger pressure, and immediately peeled off. The width in millimeters ("mm") of any peeling of paint away from the cut is reported.

(2) Water resistance of secondary adhesion test

The completely surface coated sheet was immersed in deionized water at 40° C. for 240 hours and was then cross cut to the base metal with a cutter to give one hundred squares each 1 mm on a side. The reported value is the number of squares remaining after peeling with adhesive tape applied to the painted surface after this division of the coating into squares.

As has been explained above, the phosphate conversion treatment solution according to the present invention provides for an efficient uptake into the film of nickel ion and manganese ion components in the treatment solution through the addition of formic acid or salt thereof to a zinc phosphate-based conversion treatment solution. Not only is the cost very substantially reduced, because the use of excess quantities of nickel ion and manganese ion is thus rendered unnecessary, but, in addition, films formed using the treatment solution of the present invention have a number of excellent qualities as compared to prior films:

(a) because the film is uniform, fine-sized, and dense and has an excellent alkali resistance, film loss during cathodic electrodeposition is minimized;

(b) the corrosion resistance after coating is excellent; and (c) the paint film adherence and water resistance in secondary adhesion are excellent.

What is claimed is:

1. An aqueous liquid composition, consisting essentially of water and:

(A) more than 0.5 up to about 3.0 g/L of zinc ions;

(B) about 0.5 to about 3.0 g/L of nickel ions;

(C) about 10 to about 25 g/L of phosphate ions;

(D) an accelerator component selected from the group consisting of:

(a) about 2.0 to about 15 g/L of $NO_3^-$ ions;

(b) about 0.1 to about 1.0 g/L of $ClO_3^-$ ions ; and (c) both (a) and (b);

(E) from about 0.3 to not in excess of 5.0 g/L stoichiometric equivalent of formate;

(F) about 0.5 to about 2.0 g/L of Total F Ions; and (G) about 0.01 to about 0.2 g/L of $NO_2^-$ ions; and, optionally, (H) up to about 1.5 g/L of manganese ions; and (I) up to about 2.0 g/L of nitrobenzenesulfonate.

2. A composition according to claim 1, containing at least about 0.3 g/L of manganese.

3. A composition according to claim 2, containing at least about 0.3 g/L of nitrobenzenesulfonate.

4. A composition according to claim 1 containing at least about 0.3 g/L of nitrobenzenesulfonate.

5. A composition according to claim 4 that contains at least 0.1 g/L of chlorate ions.

6. A composition according to claim 3 that contains at least 0.1 g/L of chlorate ions.

7. A composition according to claim 2 that contains at least 0.1 g/L of chlorate ions.

8. A composition according to claim 1 that contains at least 0.1 g/L of chlorate ions.

* * * * *

UNITED STATES PATENT AND TRADEMARK OFFICE

CERTIFICATE OF CORRECTION

PATENT NO. : 5,000,799

DATED : March 19, 1991

INVENTOR(S) : Seishi Kano, Shinji Takagi and Toshi Miyawaki

It is certified that error appears in the above-identified patent and that said Letters Patent is hereby corrected as shown below:

At the Cover Page, at Item [75], before "Toshi Miyawaki, Kanagawa, Japan" insert --Seishi Kano, Kanagawa-Ken; Shinji Takagi, Kanagawa-Ken;--

Signed and Sealed this

Fifteenth Day of September, 1992

*Attest:*

DOUGLAS B. COMER

*Attesting Officer*

*Acting Commissioner of Patents and Trademarks*